US006060828A

United States Patent [19]

Vollkommer et al.

[11] Patent Number: 6,060,828

[45] Date of Patent: May 9, 2000

[54] ELECTRIC RADIATION SOURCE AND IRRADIATION SYSTEM WITH THIS RADIATION SOURCE

[75] Inventors: Frank Vollkommer, Buchendorf; Lothar Hitzschke, Munich; Jens Muecke, Poecking; Rolf Siebauer, Feldkirchen, all of Germany

[73] Assignee: Patent-Treuhand-Gesellschaft fuer elektrische Gluehlampen mbH, Munich, Germany

[21] Appl. No.: 09/068,477

[22] PCT Filed: Sep. 8, 1997

[86] PCT No.: PCT/DE97/01989

§ 371 Date: May 6, 1998

§ 102(e) Date: May 6, 1998

[87] PCT Pub. No.: WO98/11596

PCT Pub. Date: Mar. 19, 1998

[30] Foreign Application Priority Data

Sep. 11, 1996 [DE] Germany ..... 196 36 965

[51] Int. Cl.[7] ..... H01J 11/00

[52] U.S. Cl. ..... 313/607; 313/234; 313/491; 313/631

[58] Field of Search ..... 313/234, 484, 313/485, 491, 607, 631, 632

[56] References Cited

U.S. PATENT DOCUMENTS 5,723,946 3/1998 Park et al. ..... 313/607

FOREIGN PATENT DOCUMENTS 0254111 1/1988 European Pat. Off. .
0312732 4/1989 European Pat. Off. .
0363832 4/1990 European Pat. Off. .
0578953 1/1994 European Pat. Off. .
4010809 10/1990 Germany .
4140497 6/1993 Germany .
4222130 1/1994 Germany .
4235743 4/1994 Germany .
4238324 5/1994 Germany .
4311197 10/1994 Germany .
61-188143 8/1986 Japan .
4-249507 9/1992 Japan .
5-247305 9/1993 Japan .
6-115000 4/1994 Japan .
7-145362 6/1995 Japan .
7-506602 7/1995 Japan .
7-228848 8/1995 Japan .
9423442 10/1994 WIPO .

*Primary Examiner*—Nimeshkumar D. Patel
*Assistant Examiner*—Todd Reed Hopper
*Attorney, Agent, or Firm*—Carlo S. Bessone

[57] ABSTRACT

A radiation source, in particular a discharge lamp suitable for operating a dielectrically hindered pulsed discharge by means of a ballast, has at least one electrode separated by dielectric material from the inside of the discharge vessel. By appropriately designing at least one of the electrodes and/or the dielectric material, local field reinforcement areas are created, so that during the pulsed mode of operation one or more dielectrically hindered individual discharges are generated exclusively in these areas, maximum one individual discharge being generated in each area. These areas are obtained in particular by shortening the spacing in locally limited areas, for example by providing on one of the electrodes hemispherical projections which extend towards the counter-electrode. This measure achieves a timestable discharge structure with a high useful radiation effectiveness uniformly distributed throughout the discharge vessel.

25 Claims, 5 Drawing Sheets

A–A

B–B

ELECTRIC RADIATION SOURCE AND IRRADIATION SYSTEM WITH THIS RADIATION SOURCE

TECHNICAL FIELD

The invention relates to an electrical radiation source and this radiation source and having a voltage source.

During operation, the radiation source emits incoherent radiation by means of a dielectrically obstructed discharge. A dielectrically obstructed discharge is generated by virtue of the fact that one or both of the electrodes, connected to the voltage source, of the discharge arrangement is or are separated by a dielectric from the discharge in the interior of the discharge vessel (discharge dielectrically obstructed at one or both ends).

Here, incoherently emitting radiation sources are UV(Ultraviolet) sources and IR(Infrared) sources as well as discharge lamps which in particular radiate visible light.

Radiation sources of this type are suitable, depending on the spectrum of the emitted radiation, for general and auxiliary lighting, for example for domestic and office lighting and for background illumination of displays, for example LCDs (Liquid Crystal Displays), for traffic lighting and signal lighting, as well as for UV irradiation, for example sterilization or photolysis.

PRIOR ART

The invention proceeds from WO 94/23442 and the mode of operation, disclosed therein, of dielectrically obstructed discharges. This mode of operation uses a sequence, unlimited in principle, of voltage pulses which are separated from one another by dead times or off periods. The pulse shape and the durations of the pulse times and dead times, inter alia, are decisive for the efficiency of the useful radiation generation. It is preferred to make use for this mode of operation of narrow, for example strip-shape, electrodes which can be dielectrically obstructed at one or two ends. For example, if two elongated electrodes are situated parallel and opposite to one another, a multiplicity of similar discharge structures are produced which, in top view, that is to say at right angles to the plane in which the two electrodes are arranged, resemble a delta (Δ), are lined up next to one another along the electrodes and widen in each case in the direction of the (instantaneous) anode. In the case of alternating polarity of the voltage pulses of a discharge dielectrically obstructed at two ends, visual overlapping of two delta-shaped structures appears. Since these discharge structures are preferably produced with repetition frequencies in the kHz range, the observer perceives only an "average" discharge structure, for example in the shape of an hour glass, corresponding to the temporal resolution of the human eye. The number of the individual discharge structures can be influenced, inter alia, by the electrical power injected. However, it is disadvantageous that individual discharge structures can, in some cases, spontaneously change their respective location along the electrodes, the result being a certain instability in the radiation distribution. In addition, the discharge structures can also accumulate in subregions of a discharge vessel, with the result that the radiation distribution can be very nonuniform with respect to the total volume of the discharge vessel.

A multitude of radiation sources for the operation by means of AC voltage are known from the patent literature. Here, too, the individual discharge structures can spontaneously change their location. Moreover, it cannot be predicted either at which particular site precisely an individual discharge will ignite. Rather, the development of the individual discharges exhibits a stochastic behaviour both spatially and temporally.

DE 40 10 809 A1, for example, discloses a high-power radiation source having electrodes of strip or wire shape arranged parallel to one another. In the respective longitudinal direction of two immediately adjacent electrodes of different polarity no location is particularly distinguished with respect to the neighbouring locations. As a consequence, the individual discharges igniting between these electrodes have one degree of freedom, corresponding to a common dimension of the parallel, elongate electrodes.

A radiation source having a first transparent and a second flat metal electrode, for instance, a metal layer, is known from EP 0 254 111 B1. The transparent electrode is realized as a transparent, electrically conductive layer or as a wire net. In the first case, that is, when two flat electrodes face one another, the individual discharges as a consequence have two degrees of freedom, corresponding to the respective two dimensions of the two electrode areas. In the second case the individual discharges can result anywhere along the warps and woofs of the wire net, and, thus, still have one degree of freedom.

Finally, a radiation source having two electrodes parallel to one another, and consisting in each case of a wire net, is known from EP 0 312 732 B1. Here, the individual discharges may in each case develop anywhere along two facing and parallel warps and woofs of both wire nets. Each individual discharge has thus again one degree of freedom, corresponding to the one common dimension of the parallel warps or woofs.

SUMMARY OF THE INVENTION

It is the object of the invention to eliminate the said disadvantages and to specify a radiation source which has a more uniform power distribution with respect to the total volume of its discharge vessel, and has a, in particular temporally, more stable total discharge. A further aspect of the invention is the improvement in the efficiency of the useful radiation generation.

This object is achieved according to the invention disclosed and claimed herein.

A further object of the invention is to specify an irradiation system which contains the radiation source.

The basic idea of the invention consists in using a multiplicity of locally limited amplifications of the electric field to create for the individual discharges starting points which are preferred in a specifically spatial fashion. The individual discharges are, as it were, forced to the sites of these local field amplifications and remain essentially fixed there, that is, they no longer have a degree of freedom to go to a location in the immediate vicinity. Consequently, the total structure of the discharge is largely stable in time. The particular form of the individual discharges plays only a subordinate role in this case. The delta-shaped and hour glass-shaped individual discharges mentioned at the beginning are certainly particularly suitable because of their high efficiency in useful radiation generation. Nevertheless, the invention is not limited to individual discharges shaped in such a way.

The sites of the local field amplification can be realized by different measures, as shown by the following simplified consideration. Using U(t) to denote the temporally varying voltage applied two electrodes arranged at a spacing d, the result is an electric field between the electrodes which has an approximate strength of $E(t)=U(t)/d$. Consequently, the local field amplifications $E(t;r=r_i)=U(t)/d(r_i)$ can be realized by local shortening of the electrode spacing d(r) at the corresponding points $r_i$, i=1,2,3, . . . n and n denoting the total number of field amplifications.

Furthermore, the electric field strength E(r) in the discharge space can be influenced by the capacitive action of the dielectric layer(s) of the obstructive electrode(s). Specifically, the capacitive effect of the dielectric weakens the electric field strength E(r) in the discharge space. According to the invention, local field amplifications $E(r=r_i)$ can therefore also be realized by locally limited reductions in the (total) thickness $b(r_i)$ and/or by increases in the relative dielectric constant(s) $\epsilon(r_i)$ of the dielectric layer(s) at the corresponding points $r_i$.

The sites of local field amplification are thus created by the specific design of at least one of the electrodes and/or of the dielectric material. The geometrical extent of sites is matched in this case to the particular dimensions of the individual discharges. In this case, the designation "design" covers both form, structure and material, as well as spatial arrangement and orientation.

The shortenings of the spacing $\Delta d(r_i)$ are achieved by specially shaped or structured electrodes which, in addition, are arranged spatially relative to one another in a suitable way. The particular design of the electrode configuration is matched to the shape or symmetry of the discharge vessel. Moreover, it is to be borne in mind when bipolar voltage pulses are used that the electrodes of different polarity act alternately as cathode or anode, and should therefore ideally be of completely identical configuration. In the case of using of unipolar voltage pulses, by contrast, it is expedient specifically to structure or shape only the cathode, since it is there that the "apices" of the delta-shaped individual discharges start.

Two or more essentially elongated electrodes, which are arranged parallel to one another, are suitable for discharge vessels which are cuboid or flat. Whether the electrodes are all arranged outside or inside, or at one end or at mutually opposite ends of the discharge vessel is of no importance for the advantageous action of the structuring of the electrode according to the invention. The only important thing is that either at least the electrodes of one polarity (discharge dielectrically obstructed at one end) or else the electrodes of both polarities (discharge dielectrically obstructed at both ends) are separated from the discharge by a dielectric layer.

At least the electrodes of one polarity are provided at regular spacings in the plane of the vessel with bulges which extend in the direction of the counter-electrode(s) in such a way as to achieve a prescribable number n of shortenings of the spacing $\Delta d(r_i)$ where i=1,2,3, . . . n. Bar-shaped electrodes having nose-like bulges or zigzag shapes as well as rectangular shapes are suitable, for example.

Semicircular or hemispherical bulges are particularly favourable, since in this case—by contrast with rectangular or triangular shapes—it is the case both that in each case a defined shortest spacing is realized and undesired apex effects are avoided.

The bulges or contours of the respective electrode are dimensioned such that on the one hand, the local field amplifications $E(r_i)$ thereby achieved are sufficiently high to generate individual discharges reliably at exclusively these sites $r_i$ of the shortenings of the spacing $\Delta d(r_i)$. On the other hand, the discharge vessel partial volume occupied by the bulges or by the contour of the electrode cannot be used by the individual discharges themselves. With the proviso of creating a discharge vessel which is as compact as possible or an efficiently used vessel volume, the aim is therefore rather a relatively small shortening of the spacing. There is therefore a need to find an acceptable compromise in the individual case.

Typical ratios between the shortening of the spacing $\Delta d(r_i)$ and the effective striking distance w for the individual discharges are situated in the range of between approximately 0.1 and 0.4. The effective striking distance w is here the respective spacing $d(r_i)$, reduced by the thickness b of the dielectric, between mutually adjacent electrodes of different polarity at the sites $r_i$, that is to say $w=d(r_i)-b$.

A combination of a helical and one or more elongated electrodes is particularly suitable for cylindrical discharge vessels. The helical electrode is preferably arranged centrally and axially in the interior of the discharge vessel. The elongated electrode or electrodes are arranged at a prescribable spacing from the lateral surface of the electrode helix, for example on the outer wall of the cylindrical lateral surface of the discharge vessel, preferably parallel to the longitudinal axis of the cylinder. This specific contouring and arrangement of the electrodes creates a multiplicity of mutually separated points with shortened electrode spacings. The pitch —that is to say, the distance within which the helix executes a complete rotation—is preferably approximately as large as the maximum transverse extent—in the case of delta-type shapes, this corresponds to the foot width—of the individual discharges, or larger, in order to prevent overlapping of the individual discharges.

It is true that a high-power source, in particular for ultraviolet light, having a helical inner electrode is already disclosed in DE 41 40 497 A1. However, this inner electrode serves only to couple a pole of an AC voltage source to a moulded part acting as a distributed auxiliary capacitor. The coupling of the electric alternating field is supported by a liquid with a high dielectric constant, preferably demineralized water ($\epsilon$=81). Moreover, the counter-electrode is realized in the form of a wire grid. Field amplifications which are limited in each case locally to the individual discharges of the type outlined at the beginning do not result from this configuration. Consequently, it is thus possible neither to generate nor to separate corresponding individual discharges in accordance with the invention.

The electrodes of the radiation source are alternately connected to the two poles of a pulsed voltage source in order to complete the radiation source to form an irradiation system. The pulsed voltage source supplies voltage pulses interrupted by interpulse periods, as disclosed, for example, in WO 94/23442.

A further aspect of the invention is largely to prevent, or else at least to limit the overlapping of individual discharges. Specifically, it has been shown that for the generation of useful radiation the efficiency increases with decreasing overlapping. On the other hand, the electric power which can be coupled into the volume of the discharge vessel can be increased by moving the individual discharges closer together or overlapping them. Consequently, in the individual case it is necessary to select a suitable compromise between the power level (stronger overlapping) and the level of efficiency (weaker overlapping). Depending on what is required, it is possible in this case to weight more heavily either the absolute value of the radiant power or the efficiency of the radiant power, that is to say in the case of visible radiation the level of light efficiency or of the light flux.

From these points of view, a spacing, normalized to the maximum transverse extent of the individual discharges, in the range of approximately 0.5 to 1.5 has proved to be suitable. In this case, normalized spacings of, for example, 0.5, 1 and 1.5 mean that the central axes of neighbouring partial discharges are removed from one another by half, one times and one and one half times their maximum transverse extent, which corresponds to overlapping, touching without overlapping or separation of the partial discharges. In the case of separated partial discharges, that is to say when there is a region free of discharge between the partial discharges, mutual influence between the partial discharges can be largely excluded.

DESCRIPTION OF THE DRAWINGS

The invention is explained below in more detail with the aid of a few exemplary embodiments. In the drawings.

DESCRIPTION OF THE PREFERRED EMBODIMENTS

Figure 1:
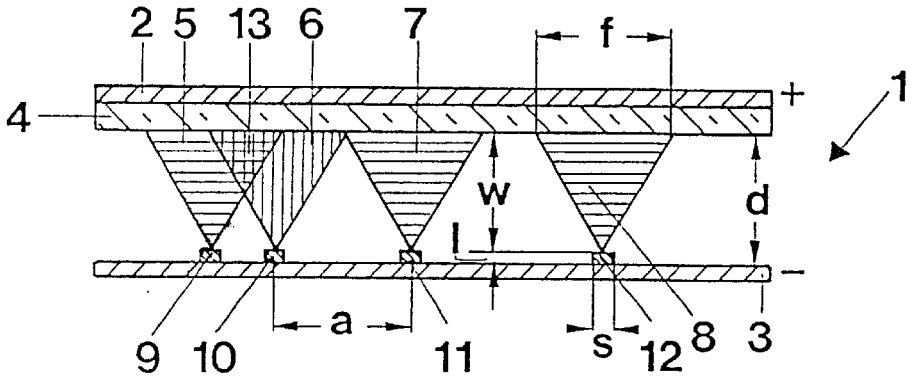
FIG. 1 shows a schematic representation of a discharge arrangement for a pulsed discharge dielectrically obstructed at one end, having two electrodes, arranged next to one another, with local shortenings of the electrode spacing.

FIG. 1 serves chiefly to explain the principle of the invention—to be precise, the specific localization of the individual discharges of a pulsed, dielectrically obstructed discharge by means of local field amplifications—more exactly of local shortenings of the electrode spacing of a discharge arrangement 1. For this purpose, FIG. 1 shows in a schematic representation a longitudinal section through the discharge arrangement 1 having two elongated electrodes 2, 3 arranged parallel to one another at a spacing d. A first 2 of the two electrodes 2, 3 is separated by a dielectric layer 4 from the adjoining discharge space extending between the two electrodes 2, 3. The second metal electrode 3 is, by contrast, uncoated. This is therefore a discharge arrangement which is dielectrically obstructed at one end and is operated particularly efficiently by means of unipolar voltage pulses. In this case, the polarity is selected such that the dielectrically obstructed electrode 2 acts as anode and the unobstructed electrode 3 therefore acts as cathode.

The cathode 3 has four nose-like protuberances 9–12, which face the anode 2. As a result, locally limited amplifications of the electric field are generated at the points of the protuberances 9–12. These specific field amplifications have the effect that—assuming a sufficiently high electric power—a delta-shaped individual discharge 5–8 starts with its apex at each of these protuberances 9–12 in each case. In order to prevent or at least to limit undesired migration of the starting points for the apices of the individual discharges 5–8 on the protuberances 9–12, the transverse extent s of the respective protuberance, that is to say the extent along the cathode 3, is relatively small by comparison with the width f of the foot of an individual discharge. Typically, the transverse extent s is approximately 1/10 of the foot width f. A further important measure is the lateral extent l of the protuberances 9–12, that is to say an extent in the direction of the respectively shortest distance to the opposite anode 2—that is to say, the shortening of the spacing $\Delta d(r_i)$ previously explained in the description. The respective spacing between the protuberances 9–12 and the anode—minus the dielectric layer 4—thus yields the effective striking distance w for the individual discharges 5–8.

Consequently, the lateral extent l is dimensioned such that, with the electrode voltage U(t) applied, a field amplification $E(t)=U(t)/w$ achieved which is sufficient to ensure reliable starting of the individual discharges 5–8. Typically, the ratio of lateral extent l to the effective striking distance w is in the range of between approximately 0.1 and 0.4.

The spacings of neighbouring individual discharges 5–8 can be influenced by the spacings a of the associated protuberances 9–12. In order to illustrate this concept, in FIG. 1 the distances between the successive protuberances 9–12, and thus also the associated individual discharges 5–8, are selected to be different. It is assumed, moreover, that the delta-shaped individual discharges 5–8 have the form of an equilateral triangle.

The mutual spacing in between the two first protuberances 9 and 10 corresponds to precisely half the foot width f of the two associated individual discharges 5 and 6, corresponding to a spacing of 0.5, normalized to the foot width f. Consequently, these two individual discharges 5 and 6 overlap one another in the overlap region 13. The mutual spacing between the second and third protuberances 6 and 7, respectively, corresponds precisely to the whole foot width f of the two associated individual discharges 6 and 7, corresponding to a normalized spacing of 1. Consequently, these two individual discharges 6 and 7 follow one another immediately, without an overlap, but also without a space free from discharge between the foot regions of the two individual discharges 6 and 7. The mutual spacing between the third and fourth protuberances 11 and 12, respectively, is, finally, larger than the foot width f of the two associated individual discharges 7 and 8, corresponding to a normalized spacing of greater than 1. Consequently, these two individual discharges 7 and 8 are separated from one another by a space free from discharge between their foot regions.

Figure 2:
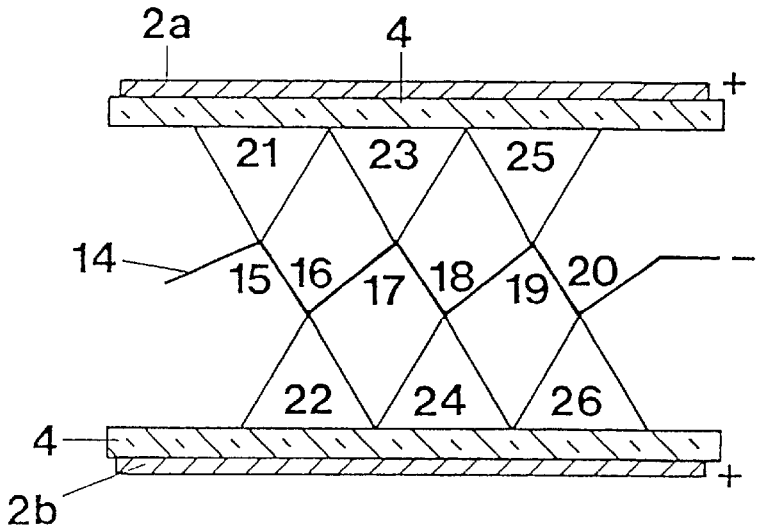
FIG. 2 shows a variation of the arrangement from FIG. 1, having two anodes and a saw-toothed cathode.
Figure 3:
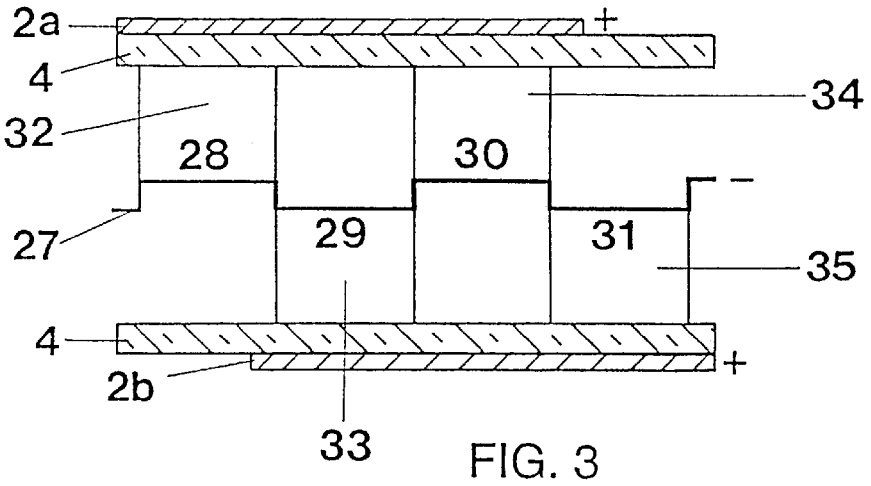
FIG. 3 shows a further variation of the arrangement from FIG. 1, having two anodes and a step-shaped cathode.

Variations of the discharge arrangement of FIG. 1 having in each case two anodes arranged parallel to one another are represented schematically in FIGS. 2 and 3. Identical features are provided with identical reference numerals.

Local shortenings of the electrode spacing are realized in FIG. 2 by a zigzag or saw-toothed cathode 14 arranged centrally in the plane of the two anodes 2*a*, 2*b*, for example bent from a metal wire. The six teeth 15–20 of the cathode 14 point alternately to one or other of the two anodes 2*a*, 2*b*. The result of this is that precisely one delta-shaped individual discharge 21, 26 starts on each of the teeth 15–20, given appropriate electric power. In this case, the individual discharges 21, 23 or 25 which start on the "odd-numbered teeth", that is to say the first tooth 15 and on the respective next-but-one teeth 17 and 19 end on one 2*a* of the anodes.

The individual discharges 22, 24, 26 starting on the "even-numbered" teeth 16, 18, 20 situated therebetween or following next end, by contrast, on the opposite, other anode 2*b*. The mutual spacings between the individual discharges can be influenced by the corresponding spacings between the teeth. In FIG. 2, the spacings between the next but one neighbouring teeth 15, 17; 17, 19 or 16, 18 and 18, 20 are in each case selected to be exactly as large as the foot width of the individual discharges 21–26. Consequently, both the "odd-numbered" and the "even-numbered" individual discharges 21, 23, 25 or 22, 24, 26 are in each case lined up immediately next to one another adjoining the two sides of the cathode 14. By contrast with FIG. 1, in FIG. 3 only the cathode 27 is changed, specifically in such a way that a sequence of four steps 28–31, bent from a metal wire, for example, extends centrally between the two anodes 2*a*, 2*b*. The steps 28–31 are oriented alternately towards one anode 2*a* or the other anode 2*b*, with the result that these steps function as local shortenings of the electrode spacing.

The discharge arrangement in FIG. 3 is particularly suitable for "curtain-like" discharge structures such as can be generated under specific discharge conditions, for example relatively low pressure of the gas or gas mixture inside the discharge vessel. Under these special conditions, delta-shaped individual discharges therefore do not form. Rather, discharges 32 and 34 or 33, 35, respectively, resembling rectangles then burn in each case between the steps 28, 30 and the neighbouring anode 2*a*, on the one hand, and between the steps 29, 31 and the neighbouring anode 2*b*, on the other hand.

In one variant, the step-like cathode is additionally coated with a thin dielectric layer (not represented). An arrangement dielectrically obstructed at both ends is realized in this way. An efficient mode of operation using bipolar voltage pulses is also possible thereby. In this case, the alignment of the delta-shaped individual discharges varies continuously with the alternating polarity of the voltage pulses in the opposite direction. The visual impression of "hour glass-shaped" individual discharges (not represented) is produced for typical pulse repetition frequencies in the range of a few tens of kilohertz.

Moreover, it is still possible to conceive for the cathode many further suitable shapes which have the feature according to the invention of locally limited shortenings of the electrode spacing. In particular, the electrodes can also be printed in the form of conductor tracks on an inner or outer wall of the discharge vessel as described, for example, in EP 0 363 832 A1. All that is essential for the advantageous action of the invention are the additional means for local field amplification, specifically one means each per individual discharge. Furthermore, instead of being arranged in a plane, the electrodes can just as well be arranged in three dimensions.

Figure 4A:
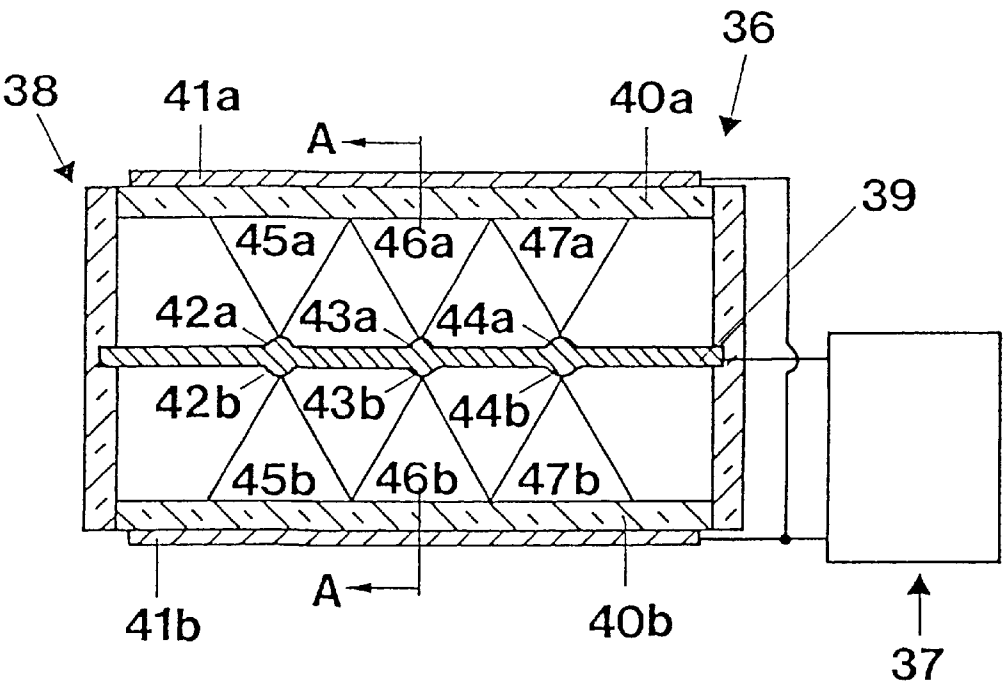
FIGS. 4*a* and 4*b* show an exemplary embodiment of a flat source having a cathode with nose-like protuberances.
Figure 4B:
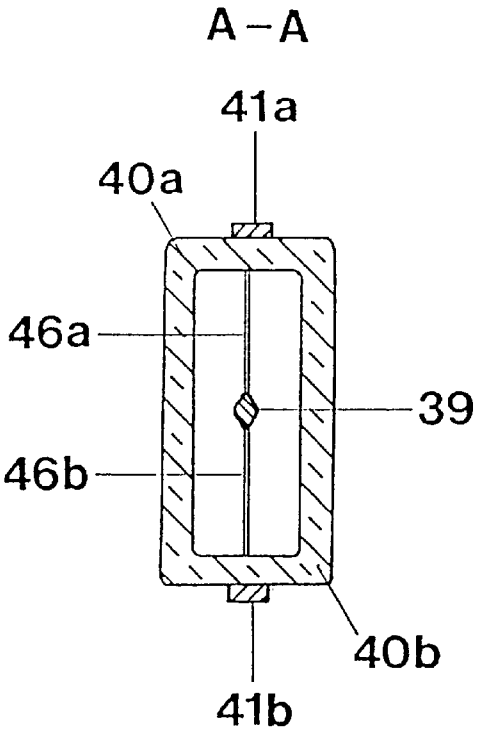

FIGS. 4*a* and 4*b* show in a schematic representation an embodiment of an irradiation system having a flat-type source 36 and an electrical power supply unit 37, partially in longitudinal section and in cross-section, respectively. The electrode arrangement is similar to that shown for explaining the idea of the invention in FIG. 1. The source 36 comprises an elongated cuboid discharge vessel 38 made from glass. Located in the interior of the discharge vessel 38 is xenon at a filling pressure of approximately 8 kPa. Centrally arranged on the longitudinal axis of the discharge vessel 38 is a first electrode 39 (cathode) connected to the negative pole of the power supply unit 37. A further strip-shaped electrode 41*a*, 41*b* (anode) made from aluminium foil, connected to the positive pole of the power supply unit 37, is arranged in each case on the outer walls of the two narrow lateral surfaces 40*a*, 40*b*, which are parallel to the longitudinal axis. The cathode 39 comprises a metal bar which is provided at a mutual spacing of approximately 15 mm with three pairs of nose-like protuberances 42*a*, 42*b*–44*a*, 44*b*. The two protuberances of each pair 42*a*, 42*b*–44*a*, 44*b* are orientated in opposite directions and towards one of the two anodes 41*a*, 41*b* each. The protuberances 42*a*, 42*b*–44*a*, 44*b* are constructed in the shape of a semicircle with a diameter of approximately 2 mm. The lateral extent l in the direction of the respective anode is thus approximately 1 mm. Together with an effective striking distance w of approximately 9 mm, this produces a value of approximately 0.11 for the quotient l/w. During operation, the power supply unit 37 supplies a sequence of negative voltage pulses having widths (full width at half height) of approximately 1 $\mu$s and a pulse repetition frequency of approximately 80 kHz. It is therefore possible to generate one delta-shaped individual discharge 45*a*, 45*b*–47*a*, 47*b* each inside the discharge vessel 38 at each of the protuberances 42*a*, 42*b*–44*a*, 44*b*. In this case each individual discharge starts with its apex at a protuberance and spreads up to the opposite side wall 40*a*, 40*b*, which acts as the dielectric layer and to whose outer wall the associated anode 41*a*, 41*b* is fastened.

Figure 5A:
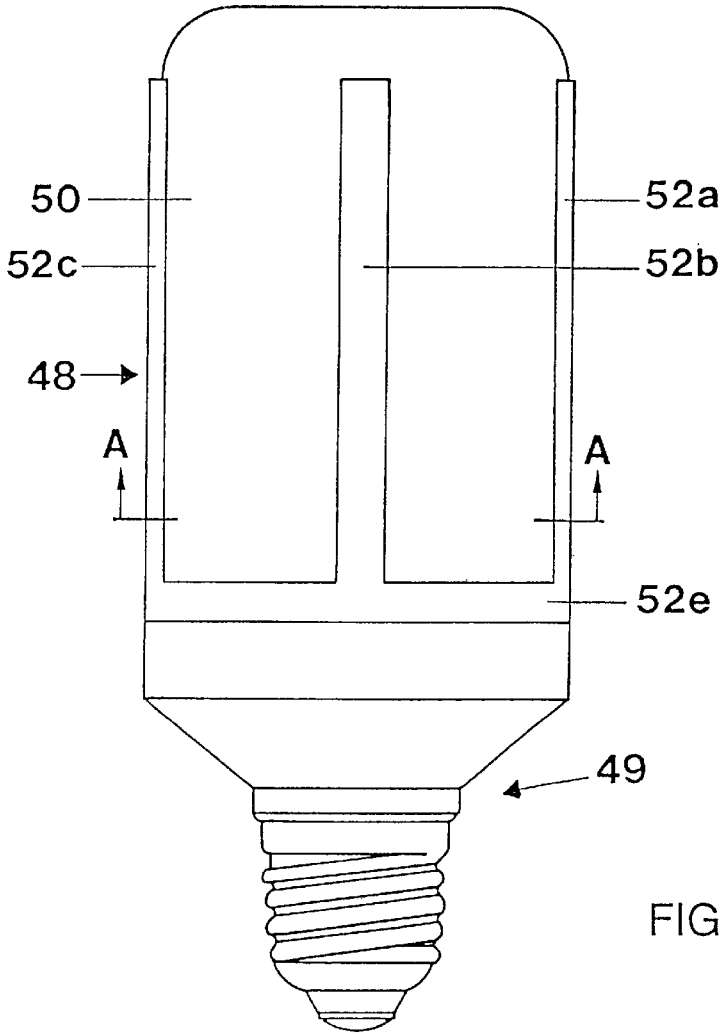
FIG. 5*a* shows an exemplary embodiment of a cylindrical discharge lamp having a spiral cathode, in a side view.
Figure 5B:
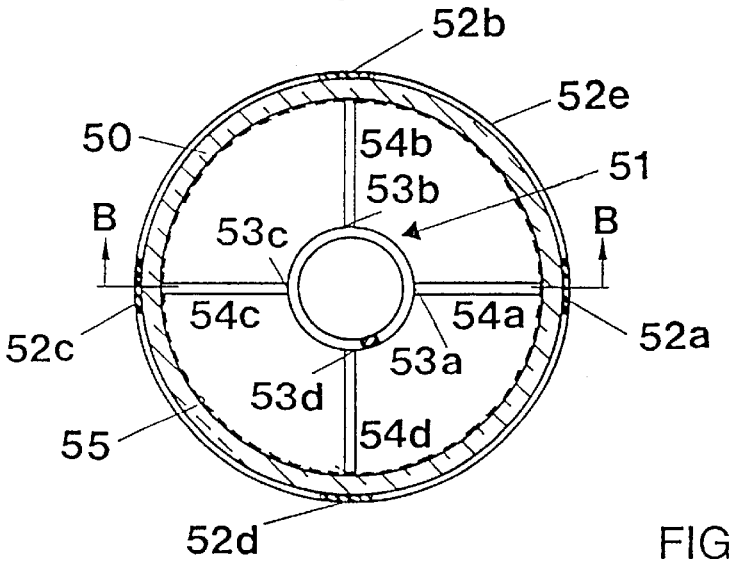
FIG. 5*b* shows the cross-section along A—A of the discharge lamp shown in FIG. 5*a,*
Figure 5C:
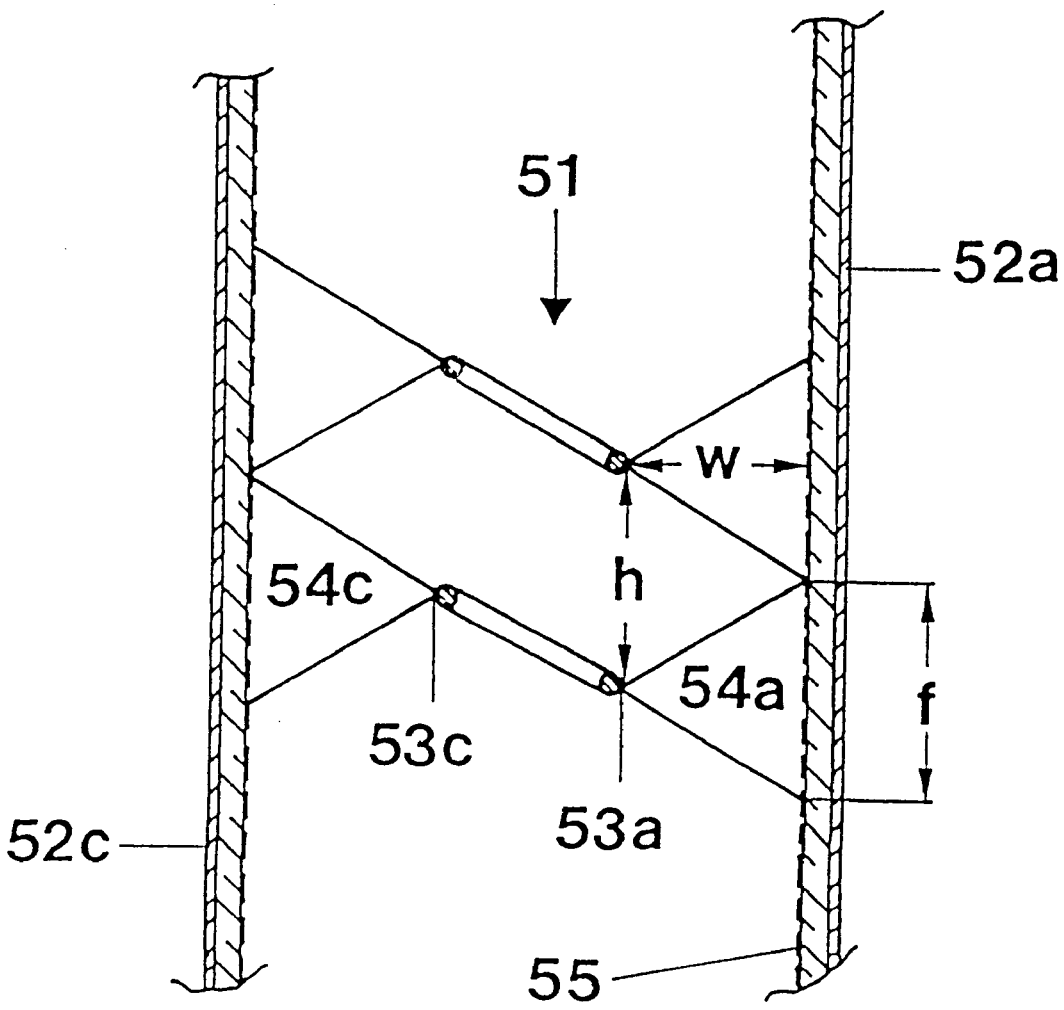
FIG. 5*c* shows a part of a longitudinal section along B—B of the discharge lamp shown in FIG. 5*a,*

A further embodiment of a discharge lamp 48 is shown in side view in FIG. 5*a*, in cross-section in FIG. 5*b*, and in a partial longitudinal section in FIG. 5*c*. In its external shape, the lamp resembles conventional lamps with an Edison cap 49. An elongated inner electrode 51 is arranged centrally inside the circularly cylindrical discharge vessel 50 made from 0.7 mm thick glass. The discharge vessel 50 has a diameter of approximately 50 mm. The interior of the discharge vessel 50 is filled with xenon at a pressure of 173 hPa. The inner electrode 51 is shaped from metal wire as a clockwise helix. The respective diameters of the metal wire and of the helix 51 are 1.2 mm and 10 mm, respectively. The pitch h—that is to say the distance inside which the helix executes a complete revolution—is 15 mm. This value corresponds approximately to the foot width f of the delta-shaped individual discharges. Four outer electrodes 52*a*–52*d* in the form of conductive silver strips 8 cm long are attached equidistantly and parallel to the longitudinal axis of the helix to the outer wall of the discharge vessel 50. Consequently, there are four equidistant points 53*a*–53*d* per turn on the outer surface of the helical electrode 51, which are immediately adjacent to the corresponding outer electrodes 52*a*–52*d*. The apex of a delta-shaped individual discharge 54*a*–54*d* starts respectively at these four points with the shortest striking distance w, and widens up to the inner wall of the discharge vessel 50 in the direction of the outer electrodes 52*a*–52*d*. These points of shortest striking distance are repeated from turn to turn and along the outer electrodes 52*a*–52*d*. In this way, the individual discharges burn in a way specifically separated from one another in two planes intersecting in the longitudinal axis of the lamp, each plane passing through two opposite outer electrodes 52*a*, 52*c* and 52*b*, 52*d*, respectively. Moreover, the specific selection of h≈f ensures that the individual discharges do not mutually overlap along the outer electrodes 52*a*–52*d*.

The outer electrodes 52*a*–52*d* are connected to one another in an electrically conducting fashion in the region of the cap of the discharge vessel 50 by means of a conductive silver strip 52*e* attached in the shape of ring to the outer wall. The inner wall of the discharge vessel 50 is coated with a fluorescent coating 55. This is a three-band fluorescent material having the blue component $BaMgAl_{10}O_{17}:EU^{2+}$, the green component $LaPO_4:(Tb^{3+}, Ce^{3+})$ and the red component $(Gd,Y)BO_3L\ Eu^{3+}$. A light efficiency of approximately 45 lm/W is thereby achieved in pulsed operation with voltage pulses of approximately 1.2 μs pulse width, separated from one another in each case by an off period of 37.4 μs. By contrast with the lamp of similar type disclosed in WO 94/23442, but with a bar electrode, that is to say without specific separation of the individual discharges, this corresponds to an increase in efficiency of approximately 12–13%. In one variant, a ballast (not represented), which supplies the voltage pulses required to operate the lamp, is integrated into the lamp cap 49.

Figure 6A:
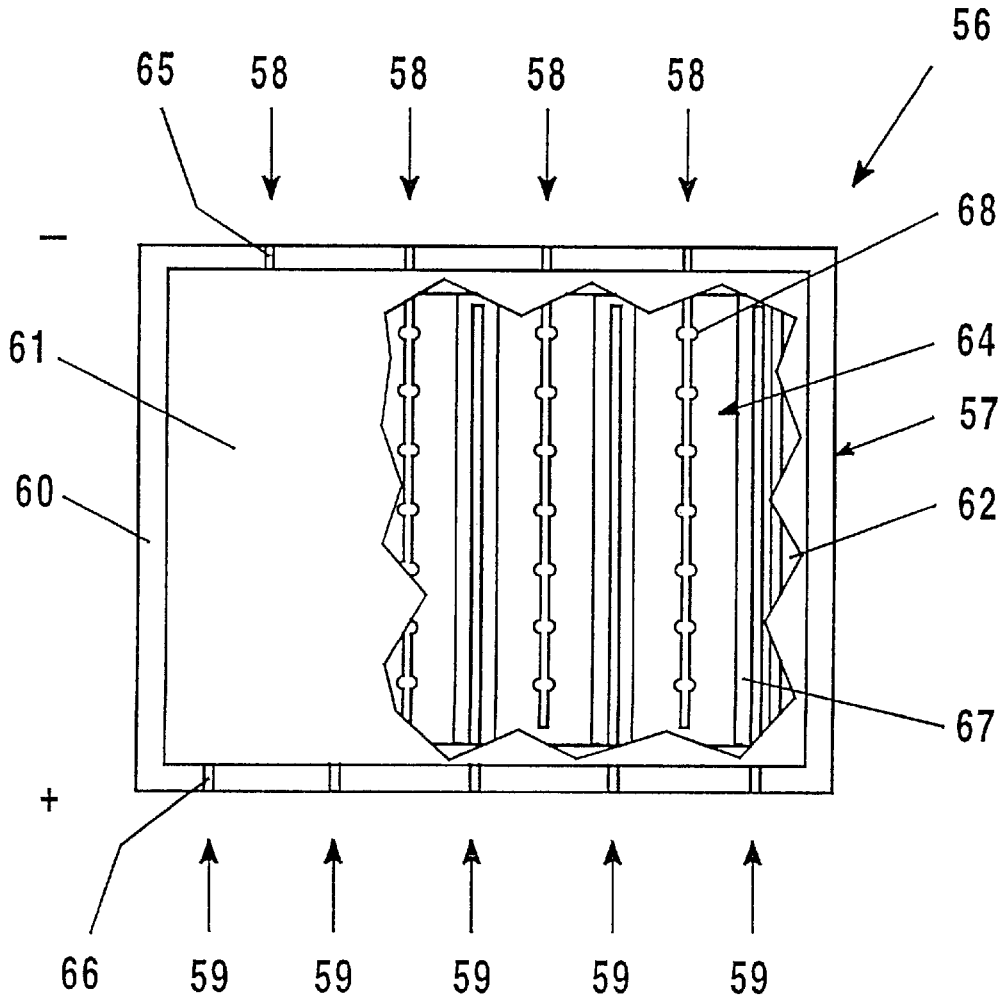
FIG. 6*a* shows a diagrammatic representation of a top view, partially broken away, of a flat lamp in accordance with the invention having, arranged on the bottom plate, electrodes with local shortenings of the electrode spacing.
Figure 6B:
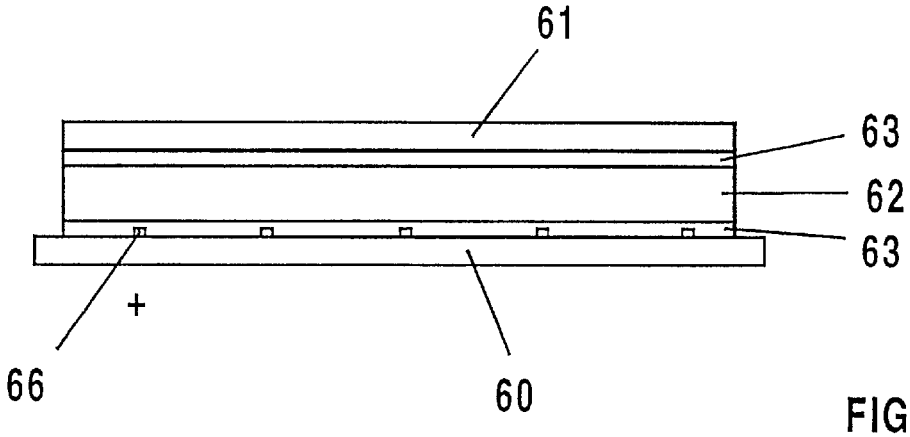
FIG. 6*b* shows a diagrammatic representation of a side view of the flat lamp of FIG. 6*a.*

The FIGS. 6*a*, 6*b* show in diagrammatic representation a top view and a side view of a flat fluorescent lamp which in operation emits white light. It is conceived as a background lighting for an LCD (Liquid Crystal Display).

The flat lamp 56 consists of a flat discharge vessel 57 with rectangular surface area, four strip-like metal cathodes 58 (–) and dielectrically obstructed anodes 59 (+). The discharge vessel 57 in turn consists of a bottom plate 60, a cover plate 61, and a frame 62. Bottom plate 60 and cover plate 61 are each joined to the frame 62 by glass solder 63 in gas-tight fashion in such a way that the interior 64 of the discharge vessel 57 is block-shaped. The bottom plate 60 is larger than the cover plate 61 in such a way that the discharge vessel 57 has a circumferential free edge. The inner wall of the cover plate 61 is coated with a phosphor mixture (not visible in the representation) which converts the UV/VUV radiation emitted by the discharge into visible white light. This is a three-band fluorescent material having the blue component BAM ($BaMgAl_{10}O_{17}:EU^{2+}$), the green component LAP ($LaPO_4:[Tb^{3+}, Ce^{3+}]$) and the red component YOB ($[Y,Gd]BO_3:Eu^{3+}$). The breakthrough in the cover plate 61 only serves for illustrative purposes and provides a view on a portion of the cathodes 58 and anodes 59.

The cathodes 58 and anodes 59 are arranged alternatingly and parallel on the inner wall of the bottom plate 60. The anodes 59 and cathodes 58 are in each case extended at their one end and are passed on the bottom plate 60 from the interior 64 of the discharge vessel 57 on both sides to. the exterior in such a way that the associated anode lead-throughs and cathode lead-throughs are arranged on opposite sides of the bottom plate. The electrode strips 58, 59 merge on the edge of the bottom plate 60 in each case into cathode-side 65 and anode-side 66 external current conductors. The external current conductors 65, 66 serve as contacts for the connection to an electric pulse voltage source (not represented). The connection to the two poles of a pulse voltage source is usually made as follows: first, the individual anode and cathode current conductors are connected in each case among one another, for example, by means of a suitable plug connector each (not represented), including connection lines. Finally, the two common anode or cathode connection lines are connected to the associated two poles of the pulse voltage source.

In the interior 64 of the discharge vessel 57 the anodes 59 are completely covered by a glass layer 67 having a thickness of approximately 250 μm.

The cathode strips 58 have nose-like, semi-circular protuberances 68 facing in each case the respective adjacent anode 59. They cause locally limited amplifications of the electric field and, in consequence, cause the delta-shaped individual discharges (not represented) to ignite exclusively at these sites and subsequently to burn there in localized fashion.

The spacing between the protuberances 68 and the respective immediately adjacent anode strip is approximately 6 mm. The radius of the semi-circular protuberances 68 is approximately 2 mm.

The individual electrodes 58, 59 including lead-throughs and outer current conductors 65, 66 are in each case configured as structures resembling continuous conductor tracks. The structures are directly applied to the bottom plate 60 by screen-print technology.

A gas filling of xenon having a fill pressure of 10 kPa is present in the interior 64 of the flat lamp 56.

The invention is not restricted to the specified exemplary embodiments. In particular, individual features of different exemplary embodiments can be combined with one another in a suitable way.

What is claimed is:

1. In a radiation source (36; 48; 56) for operating a dielectrically obstructed, pulsed discharge, the radiation source (36; 48; 56) having an at least partially transparent discharge vessel, which is closed (38; 50) and filled with a gas filling, or which is open and has a gas or gas mixture flowing therethrouqh, which discharge vessel is made from an electrically nonconductive material and has electrodes (39, 41*a*, 41*b*; 51, 52*a*–52*d*; 58, 59), at least the electrodes of one polarity (41*a*, 41*b*; 52*a*–52*d*; 59) being separated from the interior of the discharge vessel by dielectric material (40*a*, 40*b*; 50; 67), and during the pulsed operation an electric field is generated in between respective pairs of the electrodes of opposite polarity, the improvement wherein at least the electrodes of one polarity and/or of the dielectric material comprises plural, spaced apart sites for local amplification of the electric field at which dielectrically obstructed individual discharges are generated exclusively during the pulsed operation, at most one of the individual discharges being generated at each of said sites.

2. Radiation source according to claim 1, wherein said sites for local amplification of the electric field are spaced apart so that the individual discharges essentially do not overlap.

3. Radiation source according to claim 1, wherein said sites for local amplification of the electric field are spaced apart between approximately 0.5 and 1.5 times a maximum transverse extent of the individual discharges.

4. Radiation source according to claim 1, wherein said sites for local field amplification have locally limited shortenings of a spacing between the electrodes.

5. Radiation source according to claim 4, wherein the locally limited shortenings of the spacing comprise nose-like protuberances (9–12; 42*a*; 42*b*–44*a*; 44*b*; 68).

6. Radiation source according to claim 5, wherein the protuberances have the shape of a semicircle (68) or a hemisphere (42*a*; 42*b*–44*a*; 44*b*).

7. Radiation source according to claim 5, wherein the discharge vessel (57) is flat and the electrodes (58, 59) are applied in strip-like manner to at least one wall of the discharge vessel (57).

8. Radiation source according to claim 4, wherein the locally limited shortenings of the spacing are realized by the at least one electrode (27) having the shape of a square wave.

9. Radiation source according to claim 4, wherein the locally limited shortenings of the spacing are realized by the at least one electrode being a saw-tooth electrode (14).

10. Radiation source according to claim 4, wherein the locally limited shortenings of the spacing are realized by the at least one electrode being a helical electrode (51) and the other electrode being at least one elongated counter-electrode (52*a*–52*d*) that is essentially parallel to a longitudinal axis of the helical electrode (51).

11. Radiation source according to claim 10, wherein a pitch (h) of the helical electrode (51) corresponds at least to the maximum transverse extent (f) of the individual discharges (54*a*).

12. Radiation source according to claim 11, wherein a ratio between the value of the local shortening of the spacing (l) and the striking distance (w) for the individual discharges is in the range of between approximately 0.1 and 0.4.

13. Radiation source according to claim 1, wherein the sites for local field amplification are realized by appropriately locally limited (17) reductions in the thickness of the dielectric layer.

14. Radiation source according to claim 1, wherein the sites for local field amplification are realized by appropriately locally limited increases in the relative dielectric constant.

15. In an irradiation system having a radiation source (36) and a voltage source (37), which voltage source (37) is capable of supplying a sequence of voltage pulses, the individual voltage pulses being separated from one another by off periods, which radiation source (36) is suitable for a dielectrically obstructed, pulsed discharge, the radiation source (36) having an at least partially transparent discharge vessel, which is closed (38) and filled with a gas filling, or which is open and has a gas or gas mixture flowing therethrough, which discharge vessel is made from an electrically nonconductive material and has electrodes (39; 41*a*; 41*b*), at least the electrodes of one polarity (41*a*; 41*b*) being separated from the interior of the discharge vessel by dielectric material (38), which electrodes (39; 41*a*; 41*b*) are connected to the voltage source (37), and during the pulsed operation an electric field is generated in between respective pairs of the electrodes of opposite polarity, the improvement wherein at least the electrodes of one polarity and/or of the dielectric material comprises plural, spaced apart sites for local amplification of the electric field at which dielectrically obstructed individual discharges are generated exclusively at these sites during operation of the voltage source, at most one of the individual discharges being generated at each of the sites.

16. Radiation source according to claim 6, wherein the discharge vessel (57) is flat and the electrodes (58, 59) are applied in strip-like manner to at least one wall of the discharge vessel (57).

17. Radiation source according to claim 2, wherein said sites for local field amplification have locally limited shortenings of a spacing between the electrodes.

18. Radiation source according to claim 3, wherein said sites for local field amplification have locally limited shortenings of a spacing between the electrodes.

19. Radiation source according to claim 17, wherein the locally limited shortenings of the spacing comprise nose-like protuberances (9–12; 42*a*; 42*b*–44*a*; 44*b*; 68).

20. Radiation source according to claim 18, wherein the locally limited shortenings of the spacing comprise nose-like protuberances (9–12; 42*a*; 42*b*–44*a*; 44*b*; 68).

21. A radiation source comprising:

an at least partially transparent discharge vessel that has a gas-filled interior; and at least two electrodes of opposite polarity, a first of said electrodes being exposed within said interior and a second of said electrodes being separated from said interior by a dielectric, said first electrode having plural spaced apart sites from each of which no more than one dielectrically obstructed individual discharge extends straight through the gas-filled interior to the second electrode during operation of the radiation source, each said individual discharge being confined to a plane that includes the respective one of said sites and the second electrode and including a straight line between the respective one of said sites and the second electrode.

22. The radiation source of claim 21, wherein said first electrode is linear and said sites are protuberances thereon.

23. The radiation source of claim 21, wherein said first electrode is linear and is bent in a zigzag pattern and said sites are corners of said zigzag pattern.

24. The radiation source of claim 21, wherein said first electrode is linear and is bent with alternating segments that are spaced different distances from the second electrode and said sites are ones of said segments that are closer to the second electrode than others of said segments.

25. The radiation source of claim 21, wherein said first electrode is curved and said sites are points on said curve that are closest to the second electrode.

* * * * *